United States Patent [19]

Pedersen

[11] Patent Number: 4,662,386

[45] Date of Patent: May 5, 1987

[54] SUBSEA PETROLEUM PRODUCTS STORAGE SYSTEM

[75] Inventor: Kristen I. Pedersen, Houston, Tex.

[73] Assignee: Sofec, Inc., Houston, Tex.

[21] Appl. No.: 847,767

[22] Filed: Apr. 3, 1986

[51] Int. Cl.[4] ..... E02D 27/38; B65D 88/78

[52] U.S. Cl. ..... 137/236.1; 137/571; 405/210; 417/92

[58] Field of Search ..... 137/236.1, 571; 405/59, 405/210; 417/92

[56] References Cited

U.S. PATENT DOCUMENTS

| | | | |
|---|---|---|---|
| 3,114,384 | 12/1963 | Quase | 137/236.1 |
| 3,385,067 | 5/1968 | VanEek | 405/59 |
| 3,552,132 | 8/1968 | Georgii | 405/210 |
| 3,727,418 | 4/1973 | Glazier | 405/210 X |
| 3,745,770 | 7/1973 | Fraser et al. | 405/59 |
| 3,749,522 | 7/1973 | Kazama et al. | 417/92 X |
| 3,835,654 | 9/1974 | Lehanneur | 405/210 |
| 3,837,310 | 9/1974 | Toyama | 405/210 X |
| 4,007,700 | 2/1977 | Haynes et al. | 405/210 X |
| 4,351,623 | 9/1982 | Heinz et al. | 405/210 |
| 4,556,343 | 12/1985 | Cheung | 405/210 |

*Primary Examiner*—Alan Cohan
*Assistant Examiner*—John A. Rivell
*Attorney, Agent, or Firm*—Dodge, Bush & Moseley

[57] ABSTRACT

A subsea system for the storage of petroleum products or other liquids with densities lighter than water is disclosed. The system includes at least one storage tank disposed alongside a bowl-like structure. A flexible membrane sealed to a top peripheral surface of the bowl structure or a hollow bladder supported by the bowl is provided. Pipes run from the bottom of the tank to the space between the membrane and the bowl or to the interior of the bladder. Water stored in the tank is displaced to the bowl/membrane volume space or to the hollow bladder. When discharge of the petroleum products is desired, a supply/discharge valve at the top of the tank is opened and sea pressure acting on the flexible membrane forces water from the membrane/bowl space or bladder back into the bottom of the tank causing the petroleum products to be discharged via the supply/discharge pipe.

16 Claims, 10 Drawing Figures

SUBSEA PETROLEUM PRODUCTS STORAGE SYSTEM

BACKGROUND OF THE INVENTION

1. Field of the Invention

This invention relates in general to storage systems for petroleum products. Specifically, the invention relates to a subsea storage system and still more particularly, to a storage system which uses a membrane or bladder as part of its storage capacity for self-contained displacement water.

2. Description of the Prior Art

The continued growth of offshore oil and gas production far from shore has presented the problem of storing petroleum crude or processed petroleum at the production site. Such storing enables the producer to accumulate his output until a full tank or barge load is collected rather than to have to pump it directly into a barge or seagoing storage vessel on a daily basis. Such daily pumping would unnecessarily detain the vessel, because one day's production is generally less than a full load. Subsea storage is indicated because of the excessive cost of building offshore platforms far from shore to store crude oil above the sea surface, and because of the possible severe weather conditions encountered at sea.

In addition to the usual problems with which the oil producer is faced on land, environmental considerations are of great importance in connection with offshore drilling and production. Consequently, it is of paramount concern that adequate safety precautions be taken to prevent any leakage or spillage of petroleum products into the sea. As a result, production facilities located offshore are generally equipped with elaborate systems to insure that any seawater which becomes mixed with petroleum crude is filtered and cleaned prior to being returned to the sea.

One prior art attempt at solving the subsea petroleum storage problem is disclosed in U.S. Pat. No. 3,113,699 issued Dec. 10, 1963 to Crawford et al. Crawford discloses an underwater liquid storage system having one or more essentially fluid impermeable, flexible collapsible storage containers. Based upon the principle of water displacement, the containers change shape whenever liquids are introduced or withdrawn. The containers are horizontally oriented and disposed within a substantially rectangular rigid frame adapted to rest on the sea floor. The collapsible containers and enclosing frame are anchored to the sea floor to restrain them from movement due to buoyant forces and wave and current forces. The petroleum products are pumped directy into the flexible storage containers and then are discharged by the action of the sea pressure against the flexible container.

Another approach to the underwater storage system problem for petroleum products is described in U.S. Pat. No. 4,141,377 issued on Feb. 27, 1979 to Fernandez et al. Fernandez discloses an underwater storage assembly having at least one storage tank where the tank is maintained in position on a skid assembly so that one end of the tank is positioned higher than the other end. The tank includes at least one rigid cylindrical wall defining an inner chamber. A flexible membrane is secured to the inside of the inner cylindrical wall for dividing the inner chamber into first and second copartments to provide a fluid-tight compartment into a which a fluid can be received for storage and from which it can be discharged at a latter time. The tank is provided with a passage for allowing sea water to pass freely between the first compartment and the surrounding sea. A filtering apparatus associated with each tank is provided for preventing debris and sea organisms from entering a tank through its respective passage. The tank is provided at its higher end with piping for discharging fluids into and out of the membrane.

The prior art solutions to the underwater storage system problem for storing petroleum products have certain disadvantages. For example, with the Crawford apparatus should the flexible membrane develop a leak, petroleum products would immediately flow into the sea causing environmental damage. With the Fernandez invention, the use of sea water directly from the sea within the container requires expensive filtering apparatus to prevent marine organisms and silt from entering the container.

Identification of Objects of the Invention

It is therefore a primary object of the invention to provide a subsea petroleum product storage system which operates on the oil-water displacement principle, yet one in which the displacement water is self-contained permanently in a closed system and will not be in contact with the surrounding sea water.

It is a corollary object of the invention to provide an underwater storage system operating on the oil-water displacement principle which does not require large water cleaning systems such as oil separators, etc., to decontaminate the displacement water before it is discharged back into the sea as the tanks are filled with petroleum products.

SUMMARY OF THE INVENTION

The subsea oil storage system according to the invention includes a structure having, according to a preferred embodiment, two cylindrical tanks which are disposed along side each other and connected together at a suitable distance from each other by transverse structural members. The structural members also form the support for a number of elastic membranes and tub-like bowls. Pipes interconnect the storage tanks with the space between the bowls and the covering membranes. Before petroleum products are stored in the system, the storage tanks are filled with water. The spaces between the elastic membranes and the supporting bowls are emptied. As petroleum products or other liquids lighter than sea water is introduced into the top of the storage tanks, the water in the storage tanks is displaced into the space between the elastic membrane and the tub-like bowls thereby expanding the elastic membranes.

Discharge of petroleum products from the storage tanks to a tanker on the sea surface or to shore installations via a pipeline is accomplished by virtue of the static pressure of the sea water acting on the elastic membranes thereby forcing the lighter product to elevations well above sea level.

According to the invention, the storage tanks are constructed of steel and are provided a weight cap of concrete or high density material to counteract the uplift effect of the lighter than sea water product in the storage tanks. Alternatively, the tanks may be constructed of concrete prestressed to assure the oil-tight integrity of the storage tanks. The tanks have adequate submerged weight to counteract both the uplift and lateral forces due to current and wave action in order to prevent the system from being dislocated on the sea bed.

Rather than using an elastic membrane about a periphery of the tub-like bowls, a hollow bladder may be secured to a periphery surface of each bowl, thereby providing a self-contained water-tight enclosure. Such bladder eliminates the dependency of the integrity of the seal between the edge of an elastic single sheet membrane about a periphery surface of the supporting water-tight bowl.

According to the invention, an alternative embodiment is provided having a storage tank means which is supported independently of the tub-like structure having a flexible membrane. A flexible transfer piping means provides fluid communication between the bottom of the storage tank means and the bowl of the tub-like structure.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which.

DESCRIPTION OF THE INVENTION

Figure 1:
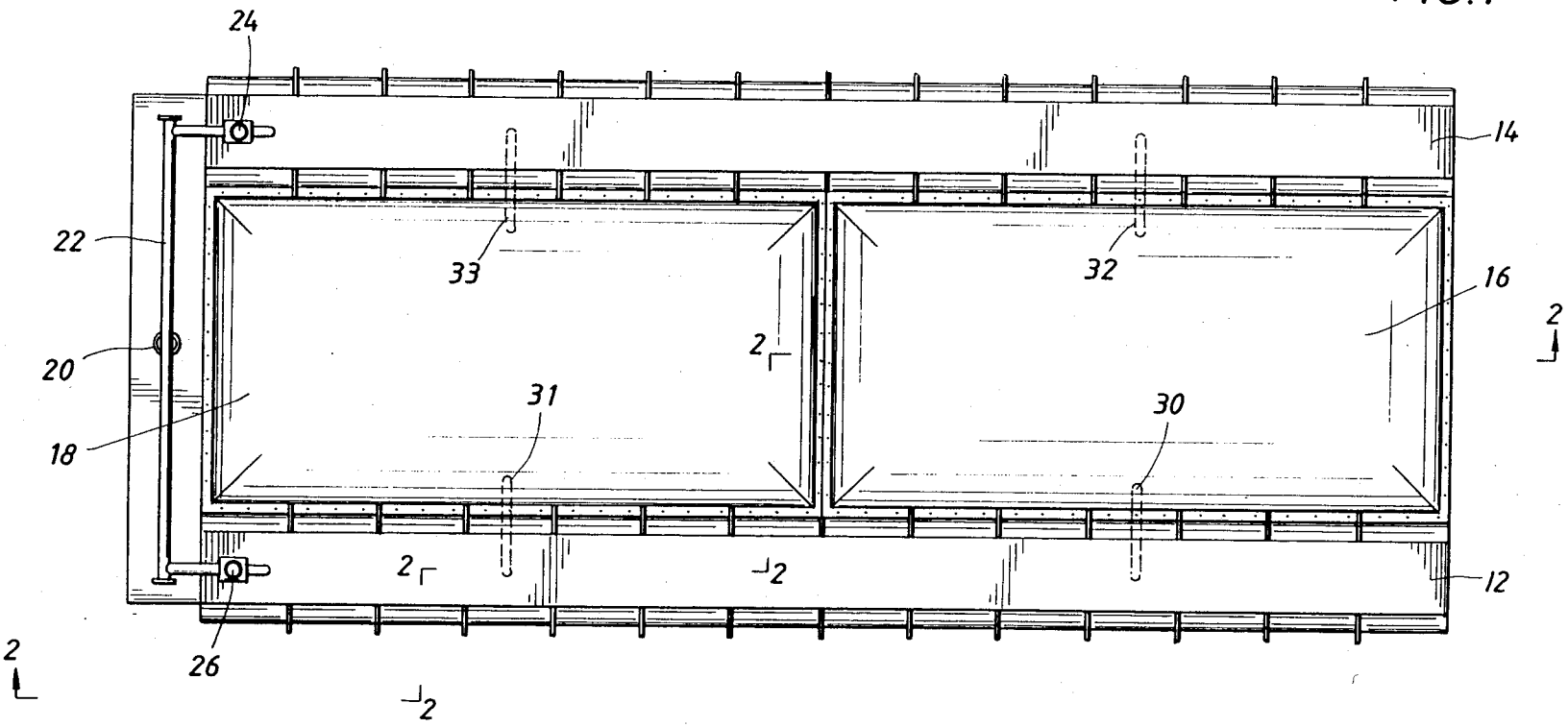
FIG. 1 is a plan view of a preferred embodiment of the subsea oil storage system according to the invention.
Figure 2:
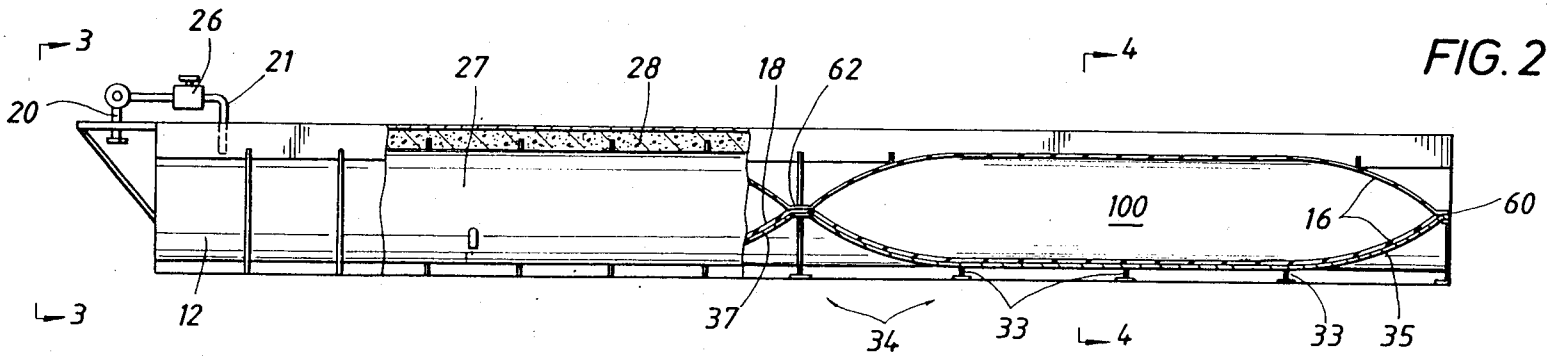
FIG. 2 is a side view of the subsea oil storage system partly cut away showing the construction of one of the two cylindrical tanks and partly showing in cross-section the configuration of the tub-like bowl structure and elastic membrane.
Figure 3:
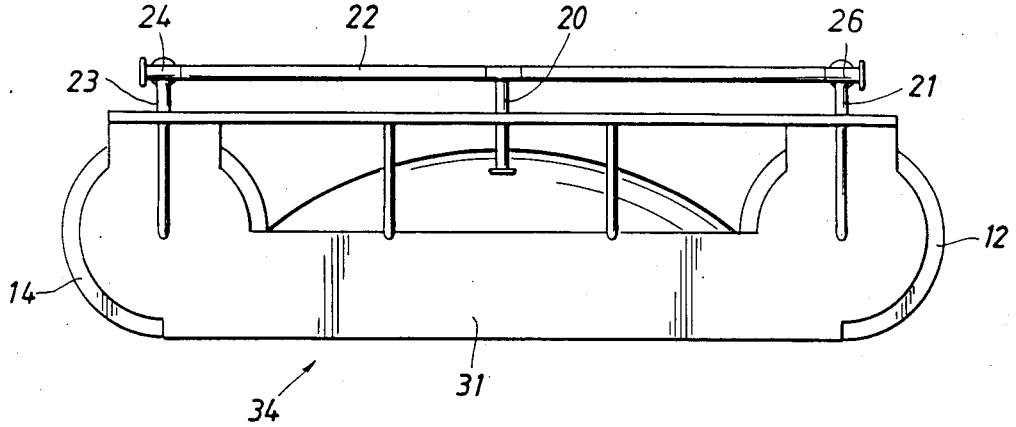
FIG. 3 is an end view of the subsea oil storage system taken from a view along lines 3—3 of FIG. 2.
Figure 4:
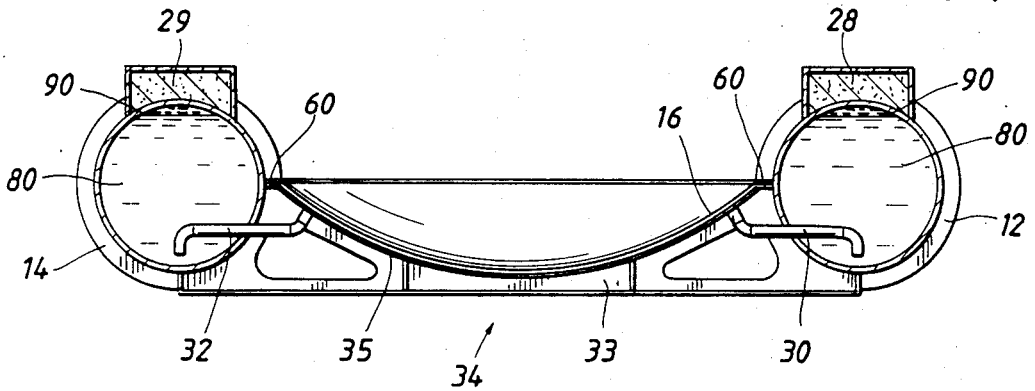
FIG. 4 is a cross-sectional view of the subsea oil storage system taken along lines 4—4 of FIG. 2 and shows the state of the system where water is stored in the cylindrical tanks and a small amount of petroleum products is also stored in the tanks.

FIGS. 1, 2 and 3 illustrate respectively, plan, side and end views of the subsea oil storage system according to the invention. In a preferred embodiment of the invention, two cylindrical tanks 12, 14 are provided alongside of one another spaced apart and connected to each other by means of a cradle 34. As illustrated in FIG. 4, cradle 34 includes a plurality of lateral support members 33 which tie the tanks 12 and 14 together and support a tub-like structure or bowl 35 between the tanks. Cradle 34 includes end members 31 as illustrated in FIG. 3.

In the preferred embodiment as shown in FIGS. 1 and 2, two such bowls 35 and 37 are provided. It should be emphasized here that the invention is not limited to providing two bowls within the cradle 34 as illustrated, but any number of such bowls could be provided depending on the design capacity of the system. It also should be emphasized that the invention is not limited to providing two parallel cylindrical tanks as illustrated in FIGS. 1, 2, 3 and 4, but the cylindrical storage tanks could take other shapes, for example, a closed outer toroidal tank could be used and having a cradle with transverse members and a bowl secured to the cradle members disposed in the interior of the toroidal shape. According to the preferred embodiment however, two such bowl-type structures 35 and 37 are provided as illustrated in the cross-sectional portion of FIG. 2.

According to the invention as illustrated in FIGS. 1, 2 and 4 an elastic membrane 16 is sealingly provided about a peripheral top edge 60 of bowl 35. Likewise, as illustrated in FIG. 2, the membrane 18 is sealingly provided about a peripheral top surface 62 of bowl 37. The membranes should be elastic, strong and fluid impermeable. Their construction may be of one or more plies of nylon fabric coated with appropriate synthetic rubber compounds. Such membranes are described in the U.S. Pat. No. 3,113,699 mentioned above and is incorporated herein for their detailed description of flexible membranes suitable for underwater storage systems.

Figure 5:
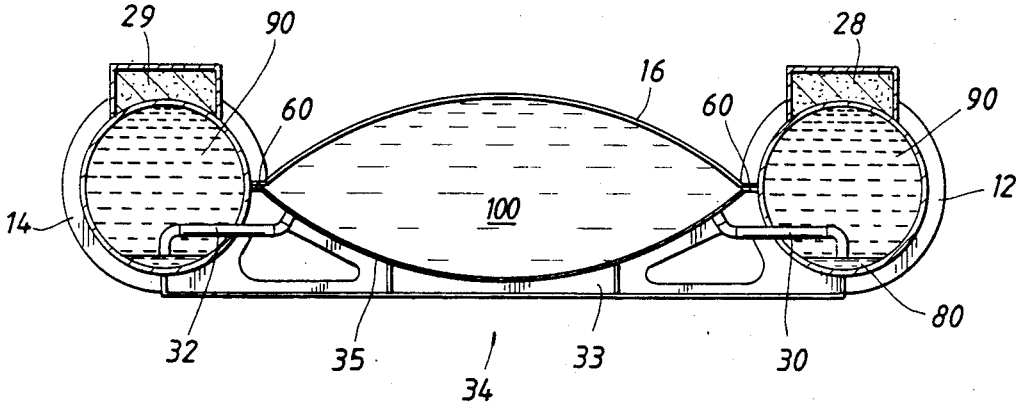
FIG. 5 is the same view as FIG. 4 but shows the state of the system in which petroleum products have been pumped into the cylindrical tanks thereby displacing water into the space defined between an elastic membrane and the tub-like bowl between the storage tanks.

The space between the membrane 16 and the bowl 35 is a closed volume 100 as illustrated in FIGS. 2 and 5 for accepting storage water 80 in tanks 12 and 14 by way of connecting pipes 30 and 32. Such connecting pipes 30 and 32 provide a communication path for the water 80 from the bottom of tanks 12 and 14 to the space between the elastic membrane 16 and the top surface of the bowl 35 as illustrated in FIG. 4. Likewise, pipes 31 and 33 are provided a communication path from the bottom of tanks 12 and 14 to the space between membrane 18 and the bowl 37 as illustrated in FIGS. 1 and 2.

As best seen in FIGS. 1, 2 and 3, supply/discharge pipes 21 and 23 are provided within the upper part of the tanks 12 and 14, respectively, and are preferably connected to a manifold 22 by way of appropriate supply/discharge valves 24 and 26. A common supply/discharge pipe 20 may be connected to the manifold 22 as illustrated in FIGS. 1, 2 and 3.

FIG. 2 shows in a partial cut away portion the construction of the tanks 12 and 14 in which a concrete cap 28 may be provided about a steel cylindrical structure 27. Alternatively, the tanks may be constructed of concrete prestressed to assure the oil-tight integrity of the storage tanks. The weight of the concrete construction or the concrete cap 28 counteracts the uplift effect of petroleum products stored in the storage tanks and provides stability for the system against the force of ocean currents.

FIGS. 4 and 5 taken along lines 4—4 of FIG. 2 in cross-section illustrate the operation of the invention. Water 80, preferably sea water, to which an agent has been added to kill marine organisms, is initially stored within the tanks 12 and 14. A small portion of petroleum products 90 is illustrated as floating on top of the water within the tanks, yet the space between membrane 16 and the bowl 35 is essentially unfilled. As petroleum products are pumped into tanks 12 and 14 via the supply/discharge pipes 21 and 23, the petroleum products 90 within the tanks 12 and 14 force the water to be displaced within the space 100 between the membrane 16 and the bowl 35 until, as illustrated in FIG. 5, a great amount of water 80 is stored in that space. The water is transferred by means of connecting pipes 30 and 32. Closing valves 24, 26 maintain the storage state of the system as illustrated in FIG. 5 indefinitely.

When it is desired to transfer the petroleum products 90 stored within tanks 12 and 14 to a tanker or other such vessel or to onshore facilities, the valves 24 and 26 are opened and the static pressure of the sea water column on the membrane 16 forces the water 80 to be transferred back to the interior of tanks 12 and 14 by way of connecting pipes 30 and 32. Consequently, the petroleum products 90 are forced via the supply/discharge pipes 21 and 23 into the manifold 22 and out of the supply/discharge pipe 20 which may be connected to a vessel or to onshore facilities.

An important advantage of the system and structure disclosed above is that it is a closed system in that the displacement water 80 is cyclicly transferred from the tanks 12 and 14 to the space between the membrane 16 and the bowl 35 (and to the space between membrane 18 and bowl 37) and is never discharged into the sea. The system thereby eliminates the need for cleaning systems such as oil separators and so on to decontaminate the displacement water because the water is never discharged back into the sea.

Figure 6:
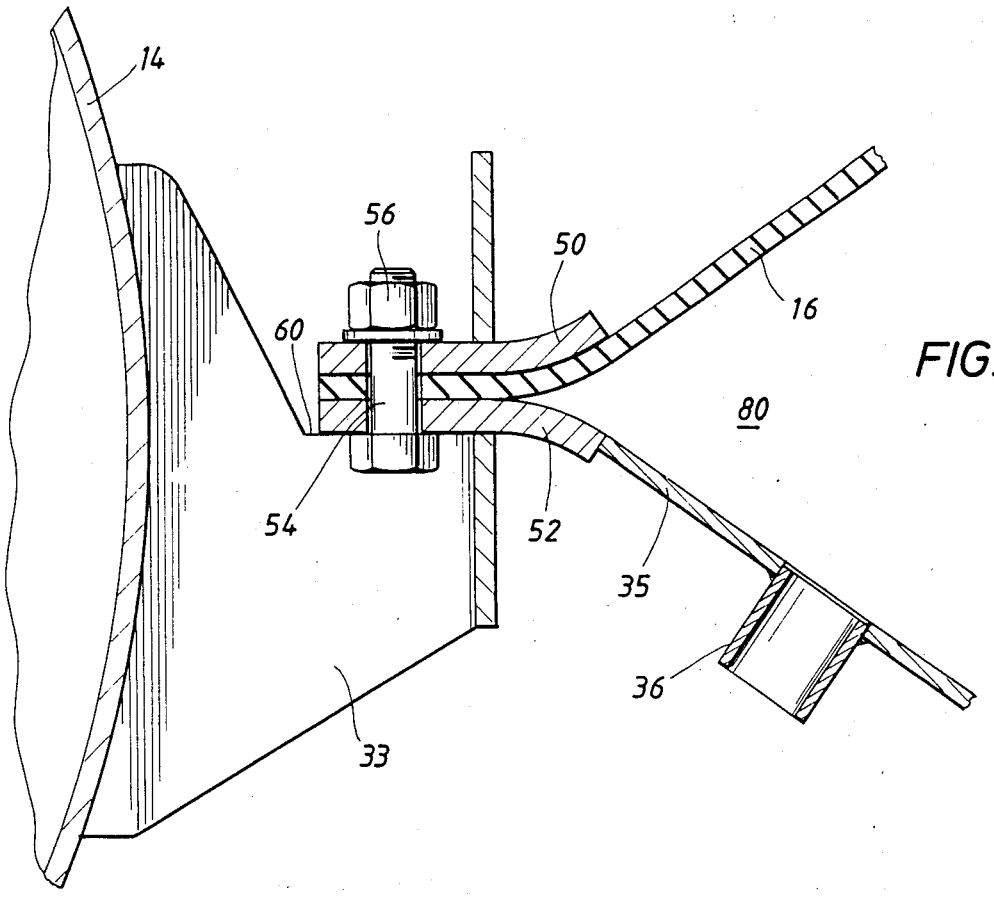
FIG. 6 illustrates one embodiment of the invention where an elastic membrane is secured about a peripheral surface of the tub-like bowl and forms a water-tight seal with such surface.

FIG. 6 illustrates the manner by which the elastic membrane 16 is secured to the peripheral surface 60 of the bowl 35. A single sheet membrane 16 is clamped between clamp bracket members 50 and 52 and is secured therebetween by a plurality of threaded bolts 54 and nut 56 passed through the bracket members and the membrane. In the embodiment of FIG. 6, the bowl 35 must be water-tight so that the displacement water may be stored between the top surface of the bowl 35 and membrane 16. A piping nipple 36 is illustrated by which the pipe 30 is connected to the space between the membrane 16 and the bowl 35.

Figure 7:
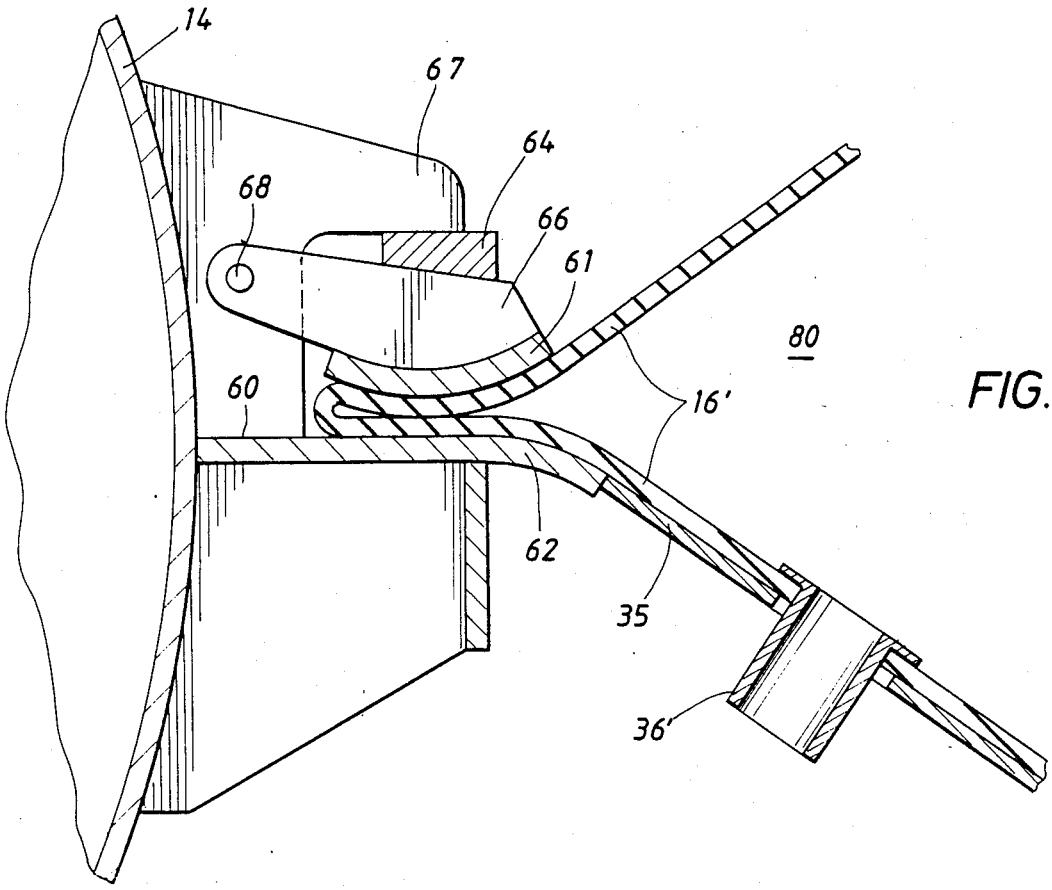
FIG. 7 shows an alternative embodiment where a closed bladder is secured about a peripheral surface about the bowl thereby forming a closed space within the bladder for the storage of displacement water.

FIG. 7 shows an alternative embodiment of the invention where a closed bladder 16' is clamped between clamp shoe 61 and clamp bracket 62 about a peripheral surface of bowl 35. A block 66 pivotable about pin 68 through cradle 34 forces the clamp shoe 61 downwardly against the bladder 16' when a wedge 64 is forced into space 67. An advantage of the embodiment of FIG. 7 is that the bowl 35 need not be made completely water-tight, because the displacement water storage space is completely within the closed bladder 16'.

Figure 8:
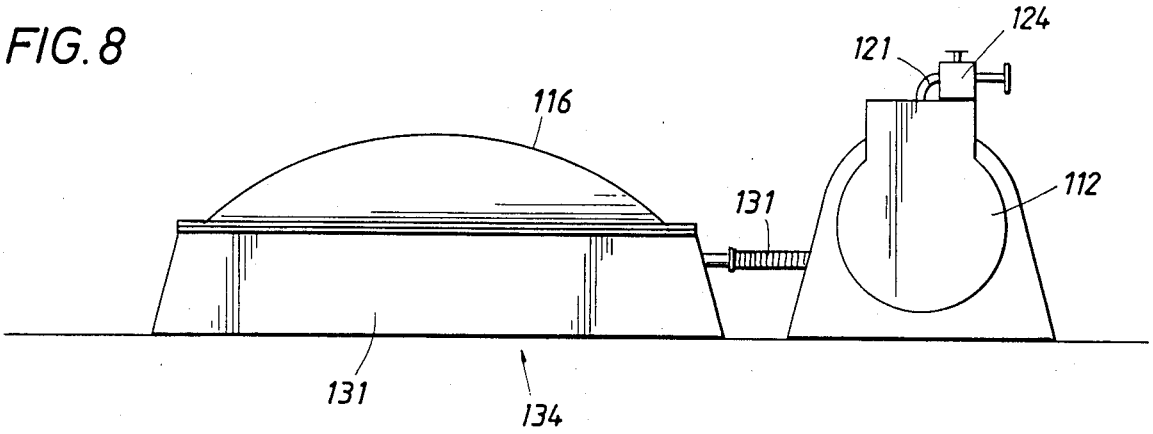
FIG. 8 is an end view of an alternative embodiment of the subsea oil storage system.
Figure 9:
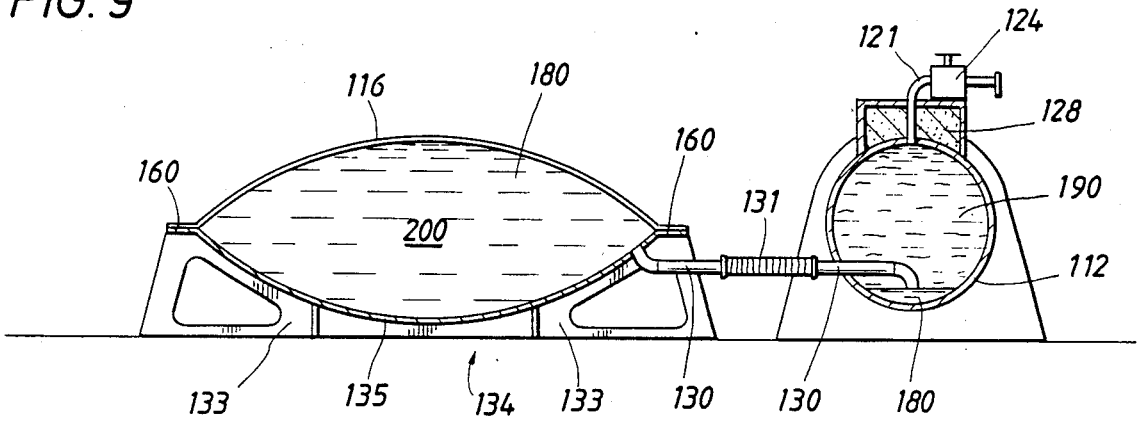
FIG. 9 is a sectional view of the alternative embodiment shown in FIG. 8 and shows the system in which petroleum products have been pumped into the cylindrical tank thereby displacing water into the space defined between an elastic membrane and the tub-like bowl.
Figure 10:
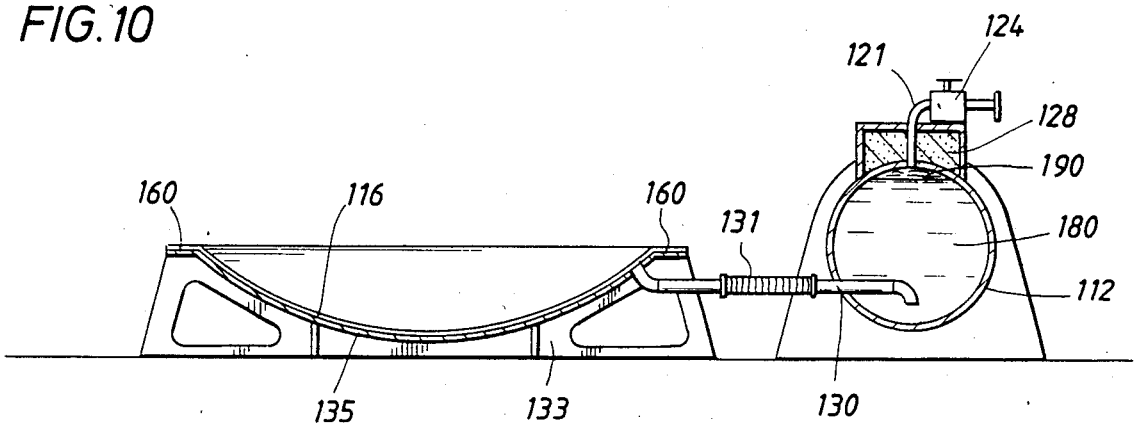
FIG. 10 is the same view as FIG. 9 and shows the state of the system where the water is stored in the cylindrical tank and a small amount of petroleum products is also stored in the tank.

FIGS. 8, 9 and 10 illustrate an alternative embodiment of the subsea oil storage system according to the invention. In the alternative embodiment of the invention, a single cylindrical tank 112 is provided adjacent, but separate and independently supported from the tub-like structure or bowl 135. The bowl 135 is supported by a cradle 134 having a plurality of lateral support members 133 and includes end members 131, as illustrated in FIG. 8.

The alternative embodiment may have a single bow or a plurality of bowls depending on the design capacity of the system, as discussed previously. Likewise, the alternative embodiment may have a single independently supported tank sized to the design capacity of the system or a plurality of tanks.

As illustrated in FIGS. 8, 9 and 10, an elastic membrane 116 is sealingly provided about a peripheral top edge 160 of the bowl 135. The elastic membrane 116 is similar in construction and material to the elastic membrane 16, as discussed previously, and is secured to the peripheral surface 160, as shown in FIG. 6. The membrane 116 could also be similar to the closed bladder 16' clamped between a clamp shoe and a clamp bracket, as discussed previously, and illustrated in FIG. 7.

The space between membrane 116 and the bowl 135 is a closed volume 200, as illustrated in FIG. 9, for accepting storage water 180 in tank 112 by way of connecting pipe 130. The connecting pipe 130 provides a communication path for the water 180 from the bottom of tank 112 to the space between the elastic membrane 116 and the top surface of the bowl 135. As seen in FIGS. 8, 9 and 10, a supply-discharge pipe 121 is provided within the upper part of the tank 112 and has a supply/discharge valve 124.

Similar to the concrete cap 28 of the preferred embodiment, the concrete cap 128 counteracts the uplift effect of petroleum products stored in the storage tanks and provides stability for the storage tanks against the forcible ocean currents. Similarly, the tub-like structure or bowl 135 is provided with weighting devices, as discussed previously, in order to prevent movement on the ocean floor.

The alternative embodiment of the subsea petroleum products storage system operates on the same oil-water displacement principal, as discussed in the preferred embodiment, and the operation is best shown in FIGS. 9 and 10. As shown in FIG. 10, water 180 is initially stored in tank 112. A small portion of petroleum products 190 is illustrated as floating on top of the water 180 within the tank 112, yet the space between the membrane 116 and the bowl 135 is essentially unfilled in FIG. 10. As petroleums products are pumped into the tank 112 via the supply-discharge pipe 121, the petroleum products 190 within the tank 112 force the water to be displaced within the space 200 between the membrane 116 and the bowl 135 until, as illustrated in FIG. 9, a great amount of water 180 is stored in that space 200. The water is transferred by means of connecting pipe 130 having a flexible hose 131.

The closing valve 124 maintains the storage state of the system, as illustrated in FIG. 9, indefinitely or until the valve 124 is opened and the static pressure on the sea water column on membrane 116 forces 180 to be transferred back to the interior tank 112 by way of connecting pipe 130.

Various modifications and alterations in the described structures will be apparent to those skilled in the art of the foregoing description which does not depart from the spirit of the invention. For example, as mentioned above the tanks according to the invention, may need not necessarily be placed alongside one another and could take the form of a number of geometrical placements. For this reason, these changes are desired to be included in the appended claims. The appended claims recite the only limitations of the present invention and the descriptive manner which is employed for setting forth the embodiments and is to be interpreted as illustrative and not limitative.

What is claimed is:

1. A subsea system for the storage of petroleum products or other liquids with densities lighter than water comprising, at least one storage tank means for containing water and said petroleum products, at least one tub-like structure disposed adjacent to said tank means, said structure having a top peripheral surface above an upwardly facing bowl, a flexible membrane secured about said top peripheral surface of said tub-like structure, transfer piping means for providing fluid communication between the bottom of said storage tank means and said bowl of said tub-like structure, and supply/discharge piping means for connecting the top of said tank means to a supply/discharge line of petroleum products, whereby where said tank means is filled with water, a portion of said water is transferred via said transfer piping means to a storage space defined between said bowl of said tub-like structure and said flexible membrane by pumping petroleum products into said tank means via said supply/discharge piping means, and after said tank means contain petroleum products, said petroleum products are forced outwardly via said supply/discharge line by the static pressure of the sea acting on said flexible membrane thereby forcing said water from said storage space via said transfer piping means to the bottom of said tank means.

2. The storage system of claim 1 wherein said storage tank means are spaced apart tanks and the storage system further comprises:

a cradle means for supportingly connecting said tanks, said cradle means having a bottom surface adapted for supporting said system on the sea floor.

3. The storage system of claim 2 wherein, said tub-like structure secured to said cradle means between said spaced apart tanks, and said transfer piping means provides fluid communication between the bottom of said spaced apart tanks and said bowl.

4. The storage system of claim 2 wherein said storage tank means includes two cylindrical storage tanks disposed alongside each other and said cradle means includes transverse structural members connected to said storage tanks operably tying said tanks together.

5. The system of claim 4 further including a second tub-like structure secured to said cradle means between said spaced apart tanks, said structure having a second top peripheral surface above a second upwardly facing bowl, a second flexible membrane secured about said second top peripheral surface of said second tub-like structure, and second transfer piping means for providing fluid communication between the bottom of said spaced apart tanks and said second tub-like structure.

6. The system of claim 1 wherein said tank includes a cap fabricated of high density material operably counteracting the uplift effect of petroleum products when stored in said tanks.

7. The system of claim 1 wherein said flexible membrane is a single sheet of elastic material sealed about said top peripheral surface of said tub-like structure, and said bowl of said tub-like structure is water-tight.

8. The system of claim 1 wherein said flexible membrane is a hollow bladder operably providing a self-contained water-tight enclosure.

9. The system of claim 1 wherein said piping means is a flexible hose to provide fluid communication between said storage tank means and said tub-like structure.

10. The system of claim 1 wherein said tank is separate from said tub-like structure and said tank is independently supported.

11. A subsea system for the storage of petroleum products or other liquids with densities lighter than water comprising, two cylindrical storage tanks spaced apart from each other and disposed substantially alongside each other, a cradle supportingly connecting said tanks, said cradle having a bottom surface adapted for supporting said tanks on the sea floor, a bowl-like structure secured to said cradle between said tanks, said structure having a peripheral surface above the bowl of the structure, a flexible membrane sealedly secured about said peripheral surface of said bowl-like structure, the space between said flexible membrane and said bowl-like structure defining a water-tight variable storage volume, first and second transfer pipes disposed between said water-tight variable storage volume and a lower interior part respectively of each of said two storage tanks, and first and second supply/discharge pipes connected to the top of said two tanks.

12. The system of claim 11 further comprising a manifold pipe connected to said first and second pipes, and a common supply/discharge pipe connected to said manifold pipe.

13. The system of claim 11 further comprising displacement water stored within said tanks and said water-tight storage volume, whereby a portion of said water disposed within said storage tanks is transferred via said first and second transfer pipes to said water-tight storage volume when petroleum products are pumped into said tanks via said first and second supply/discharge pipes, and when said tanks contain petroleum products, said petroleum products are forced outwardly via said supply/discharge lines by the static pressure of the sea acting on said flexible membrane thereby forcing water from said storage volume via said first and second transfer pipes to the bottom portion within said tanks.

14. A subsea system for the storage of petroleum products or other liquids with densities lighter than water comprising, two cylindrical storage tanks spaced apart from each other and disposed substantially alongside each other, a cradle supportingly connecting said tanks, said cradle having a bottom surface adapted for supporting said tanks on the sea floor, a bowl-like structure secured to said cradle between said tanks, said structure having a peripheral surface above the bowl of the structure, a flexible hollow bladder secured about said peripheral surface of said bowl-like structure, the interior of said bladder defining a water-tight variable storage volume, first and second transfer pipes disposed between said water-tight variable storage volume and a lower interior part respectively of each of said two storage tanks, and first and second supply/discharge pipes connected to the top of said two tanks.

15. The system of claim 14 further comprising a manifold pipe connected to said first and second pipes, and a common supply/discharge pipe connected to said manifold pipe.

16. The system of claim 14 further comprising displacement water stored within said tanks and said water-tight storage volume, whereby a portion of said water disposed within said storage tanks is transferred via said first and second transfer pipes to said water-tight storage volume when petroleum products are pumped into said tanks via said first and second supply/discharge pipes, and when said tanks contain petroleum products, said petroleum products are forced outwardly via said supply/discharge lines by the static pressure of the sea acting on said flexible membrane thereby forcing water from said storage volume via said first and second transfer pipes to the bottom portion within said tanks.

* * * * *